US008272580B1

(12) United States Patent
Schoppe

(10) Patent No.: US 8,272,580 B1
(45) Date of Patent: Sep. 25, 2012

(54) GOLF HOLE PAINTER

(75) Inventor: Terry L. Schoppe, Cedar Falls, IA (US)

(73) Assignee: Standard Golf Company, Cedar Falls, IA (US)

( * ) Notice: Subject to any disclaimer, the term of this patent is extended or adjusted under 35 U.S.C. 154(b) by 478 days.

(21) Appl. No.: 12/692,378

(22) Filed: Jan. 22, 2010

(51) Int. Cl.
*B05C 7/02* (2006.01)
*B05D 1/02* (2006.01)

(52) U.S. Cl. ..... 239/337; 239/288.3; 239/288; 222/174; 222/167; 118/317; 118/323; 118/DIG. 10; 427/230; 427/236; 427/421.1; 427/427.3

(58) Field of Classification Search ..... 239/288.3, 239/288, 337; 222/635, 174, 167; 427/230, 427/236, 421.1, 425, 427.3; 118/317, 323, 118/DIG. 10
See application file for complete search history.

(56) References Cited

U.S. PATENT DOCUMENTS

| | | | | |
|---|---|---|---|---|
| 3,013,528 | A | 12/1961 | Bland | |
| 3,149,761 | A | 9/1964 | Harris et al. | |
| 3,510,028 | A | 5/1970 | Batistelli | |
| 3,572,591 | A | 3/1971 | Brown | |
| 4,043,295 | A | 8/1977 | Speck et al. | |
| 4,797,305 | A | 1/1989 | Schleicher | |
| 5,307,964 | A * | 5/1994 | Toth | 222/402.13 |
| 5,368,202 | A | 11/1994 | Smrt | |
| D355,824 | S | 2/1995 | Smrt | |
| 6,455,104 | B1 | 9/2002 | Kirwan | |
| 7,905,430 | B1 * | 3/2011 | Kumar | 239/337 |
| 2008/0296407 | A1 | 12/2008 | Schleicher | |
| 2011/0042488 | A1 * | 2/2011 | Zigmans | 239/337 |

FOREIGN PATENT DOCUMENTS

| | | | |
|---|---|---|---|
| CA | 2594136 | A1 | 1/2009 |
| GB | 2352197 | A | 1/2001 |

OTHER PUBLICATIONS

Pot Painter, found at website http://www.potpainterusa.com, (Jun. 2010).

* cited by examiner

*Primary Examiner* — Laura Edwards
(74) *Attorney, Agent, or Firm* — McKee, Voorhees & Sease, P.L.C.

(57) ABSTRACT

A golf hole painter is provided for painting an area of a golf hole above a top of a golf cup, but below the putting surface. The golf hole painter includes a base member, a liner, and a main body. The main body is rotatably attached to the base member. The main body also receives a spray canister containing paint, which is pressed and rotated along with the main body in relation to the base member to spray the entire interior periphery of a golf hole. The painted portion of the golf hole allows a golfer to more easily view a golf hole while putting on a golf green, due to the rules of golf requiring a golf cup to sit at least one inch below the putting surface.

32 Claims, 9 Drawing Sheets

GOLF HOLE PAINTER

FIELD OF THE INVENTION

The present invention relates generally to a golf hole painter, and more particularly to an improved method and apparatus for painting the interior wall of a golf hole at an area above the top of a golf cup.

BACKGROUND OF THE INVENTION

According to the United States Golf Association's (USGA) rules of golf, a golf hole must be 4.25 inches (108 mm) in diameter and at least 4 inches (101.6 mm) deep. If a lining is used, it must be sunk at least one inch (25.4 mm) below the putting green surface, unless the nature of the soil makes it impracticable to do so; however, its outer diameter must not exceed 4.25 inches (108 mm).

While a golfer may attempt to hit his or her ball as close to the hole as possible, there is a good chance that the ball may end up on a part of the green far from the hole. Because the hole liners (i.e. cups) are sunk at least one inch below the putting green surface, the golfer may not be able to see the sunken cup from a distance. All that would be visible to the golfer would be a one inch strip of earth, which would likely be dirt. Because dirt is earthen colored and does not provide much contrast with the putting surface, the golfer may have trouble detecting the location of the golf hole, which could result in missed putts.

To improve the visibility of the hole, it is known to paint the one inch strip of earth between the top of the golf cup and the putting green a light color, such as white. The white paint gives the appearance of the golf cup extending all the way to the putting surface, which allows a golfer away from the hole to more easily detect the location of the golf hole, while still staying within the rules of the game.

One way to apply the paint is to have a golf course greenskeeper physically paint the area with a brush and a can of paint. However, this approach is time-consuming, and paint can easily spill on the cup or the putting surface of the green.

Another approach is to use a spray paint canister. A greenskeeper may choose to simply hold the canister in his or her hand and to spray paint the area inside the golf hole. Again, this approach is time intensive, and it is difficult to apply the paint only where desired.

Another approach is to use a spray paint canister as disclosed in U.S. Pat. No. 4,797,305 (the '305 patent). However, the apparatus described in the '305 patent suffers from several deficiencies. First, the apparatus rests on the putting surface and thus has the potential for damaging or altering the otherwise smooth surface around the hole. Another disadvantage is that the apparatus disclosed does not allow for the full interior periphery of a golf hole to be painted with one continuous motion. Rather, when the spray canister is depressed and rotated, the arms extending into the hole block the stream of paint from the canister, which results in areas of the hole that are not painted. To fully paint the entire interior periphery, the apparatus must be rotated and the canister reinserted to apply more paint. Further, because the apparatus only has arms and a nozzle depresser disposed inside the hole, there is nothing to block the stream of paint from contacting the golf cup.

Accordingly, there is a need in the art for an improved golf hole painting apparatus that overcomes the deficiencies in the art.

BRIEF SUMMARY OF THE INVENTION

It is therefore a principal object, feature, or advantage of the present invention to provide an improved apparatus and method for painting the interior of a golf hole.

Another object, feature, or advantage of the present invention is to provide an improved method and apparatus for painting the interior of a golf hole that paints only a regulation sized strip between a golf cup and a putting surface.

Another object, feature, or advantage of the present invention is to provide an improved method and apparatus for painting the interior of a golf hole to aid in a golfer's view of a golf hole.

Another object, feature, or advantage of the present invention is to provide an improved method and apparatus for painting the interior of a golf hole that does not rest on the putting surface.

Another object, feature, or advantage of the present invention is to provide an improved method and apparatus for painting the interior of a golf hole that paints the full interior periphery of the golf hole with one continuous stream of paint.

Another object, feature, or advantage of the present invention is to provide an improved method and apparatus for painting the interior of a golf hole that blocks a stream of paint from unintentionally spraying a golf cup in the hole.

Another object, feature, or advantage of the present invention is to provide an improved method and apparatus for painting the interior of a golf hole that blocks a stream of paint from unintentionally spraying onto the putting surface.

Another object, feature, or advantage of the present invention is to provide an improved apparatus for painting the interior of a golf hole, the apparatus including an offset nozzle receiver to spray a stream of paint from a shorter distance to ensure a consistent and desired amount of paint to the hole interior.

Yet another object, feature, or advantage of the present invention is to provide an improved method and apparatus for painting the interior of a golf hole that reduces the amount of time and paint needed to paint the hole.

These and/or other objects, features, and advantages of the present invention will be apparent to those skilled in the art. The present invention is not to be limited to or by these objects, features and advantages.

According to one aspect of the present invention, a new golf hole painter is provided. The golf hole painter includes a base member, a liner, and a main body. The base member is generally circularly shaped and has a top member, an aperture through the top member and a wall extending downwardly from the top member. The liner is positioned in the aperture of the base member. The main body includes a canister receiving member connected to a nozzle receiving member, and a clevis pin extending outwardly from the nozzle receiving member. The main body is rotatably connected to the liner such that the canister receiving member is configured to rotate about the entire interior periphery of a golf hole.

According to another aspect of the present invention, a method for painting an interior of a golf hole is provided. The method includes providing a golf hole painter including a base member having a top member, an aperture through the top member and a base member wall, a liner positioned in the aperture of the base member, and a main body having a canister receiving member, a nozzle receiving member, a clevis pin extending outwardly from the nozzle receiving member and rotatably connected to the liner, and a spraying canister containing paint and having a spraying nozzle. The golf hole painter is inserted into a golf hole having a golf cup disposed therein, with the top member of the base resting on the rim of the golf cup. The spraying canister is inserted into the canister receiving member, and the spraying nozzle is inserted into the nozzle receiving member. The spraying canister is then depressed to initiate spraying paint from the canister towards the interior wall of the golf hole.

According to yet another aspect of the present invention, a golf hole painting apparatus is provided. The golf hole painting apparatus includes a base member, a liner, and a main body. The base member has a generally circular shape and has a top member, a base member wall extending downwardly from the top member, a circular aperture through the top member and having an axis though the center of the base member, and an annular groove in the base member wall below the top member. The liner is forcibly fit into the circular aperture and has first and second ends, an inner diameter, and an outer diameter, wherein the outer diameter is slightly smaller than the diameter of the circular aperture of the base member. The main body is rotatably connected to the liner such that the canister receiving member is configured to rotate about the entire interior periphery of a golf hole. The main body includes a circular canister receiving member having an canister receiver axis through the center of the canister receiving member; a nozzle receiving member attached to the canister receiving member and having a nozzle receiver, wherein the nozzle receiver is aligned with the canister receiver axis; and a clevis pin extending outwardly from the nozzle receiving member having a clevis axis through the center of the clevis pin, a clevis pin end away from the nozzle receiving member, and a clevis groove at a position proximate the clevis pin end, wherein the clevis axis is offset from the canister receiver axis.

DETAILED DESCRIPTION OF THE INVENTION

Figure 1:
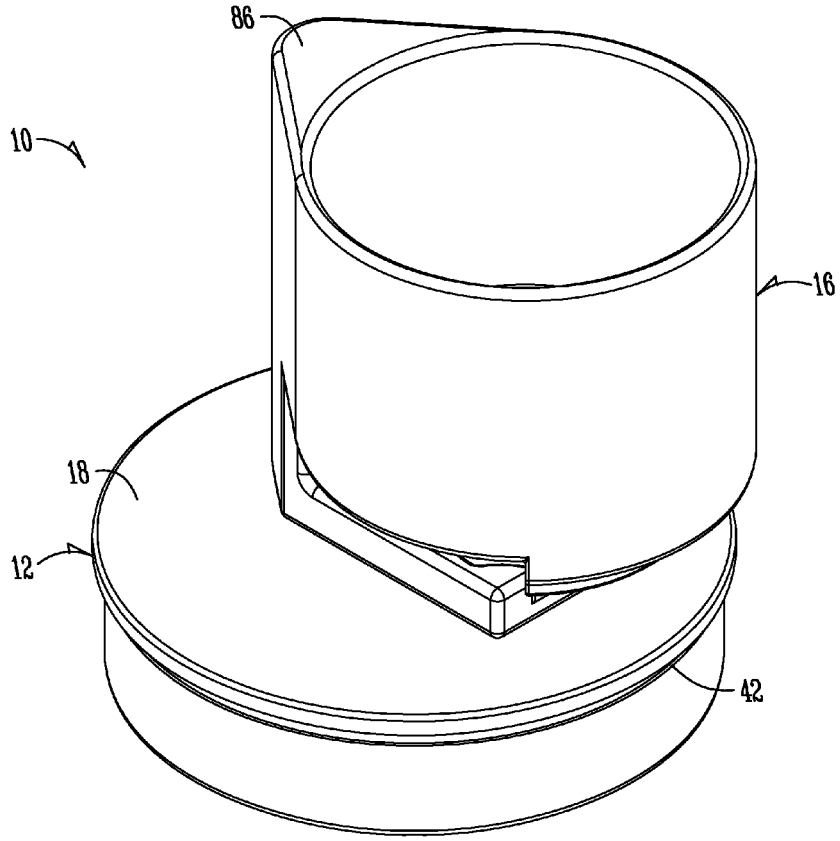
FIG. 1 is a perspective view of the golf hole painter of the present invention.
Figure 2:
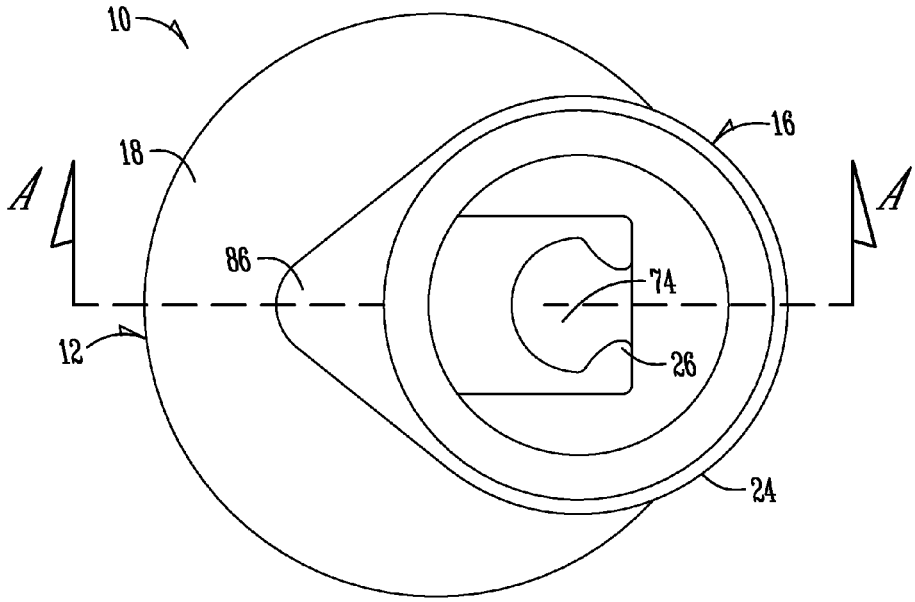
FIG. 2 is a perspective top view of the golf hole painter of FIG. 1.

Referring to FIGS. 1-4, a golf hole painter is generally designated by the numeral 10. The golf hole painter 10 includes a base member 12, a liner 14, and a main body 16. As later discussed herein, the golf hole painter 10 may also include a washer 40 and an O-ring 42. Additionally, a snap ring 48 may be used.

Figure 5:
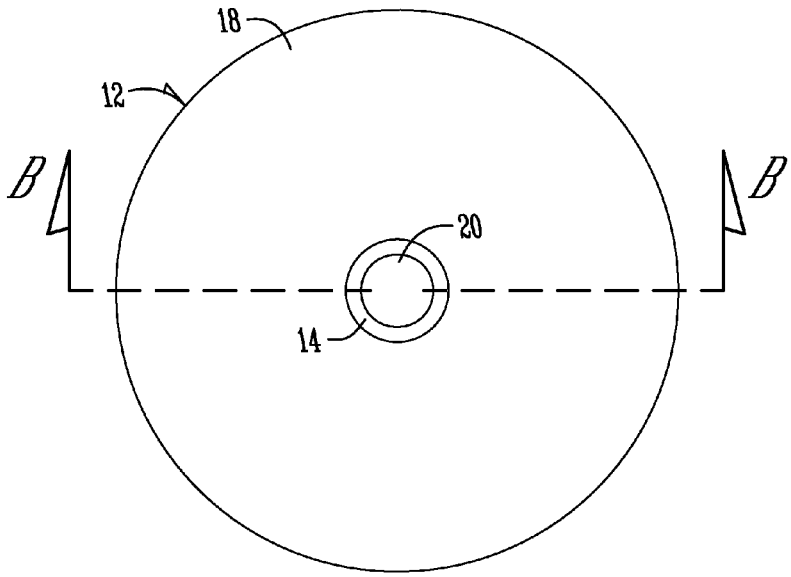
FIG. 5 is a perspective top view of the base member of the golf hole painter of FIG. 1.
Figure 6:
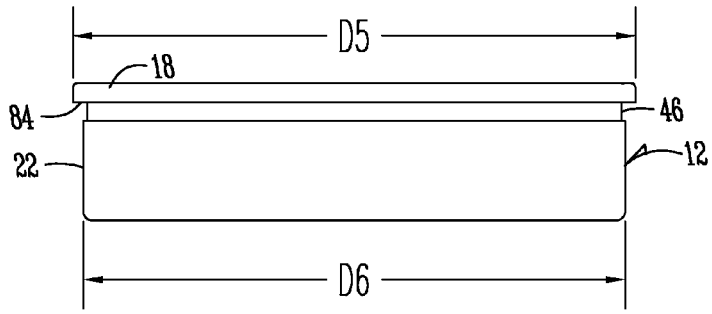
FIG. 6 is a perspective side view of the base member of FIG. 5.
Figure 7:
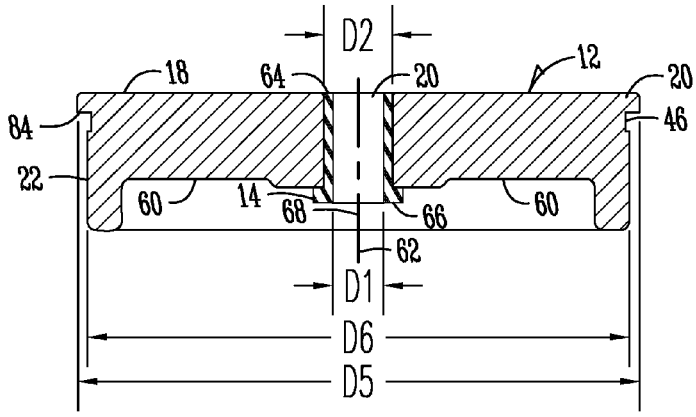
FIG. 7 is a sectional view of the base member according to the line B-B of FIG. 5.

Now referring to FIGS. 5-7, the base member 12 will be described in more detail. The base member 12 includes a top member 18, an aperture 20 through the top member 18, a wall 22 extending downwardly from the top member, and a base wall annular groove 46 around the wall 22. While the base wall annular groove 46 may be desired, it is not necessary in a preferred embodiment. A liner 14 may be press fit into the aperture 20 through the top member 18 of the base member 12. The base member may also include support members 60, which extend from the interior of the wall 22 towards the base member axis 68, but ending at the outer wall of the liner 14. As can be seen in FIG. 7, the liner 14 and the base member 12 have overlapping axes 62 and 68, and the diameter of the aperture 20 may be approximately the same size as the liner outer diameter D2, so as to create a tight fit of the liner 14 in the aperture 20 of the base member 12, to thereby prevent the liner 14 from sliding. Additionally, the liner 14 includes a first end 64 and a second end 66, wherein the first end 64 is generally flush with the surface of the top member 18 when the liner 14 is pressed into the aperture 20. Further, as seen in FIG. 7, the liner 14 includes a liner inner diameter D1. The base member 12 has a wall diameter D6 and a top member diameter D5, which is slightly larger than the wall diameter D6. This creates a top member lip 84, extending wider than the wall 22. In an additional embodiment, the base member 12 may include base wall annular groove 46.

The base member 12 may be made of die cast aluminum or other suitable materials. The liner 14 may be made of a hard plastic or other suitable material.

Figure 8:
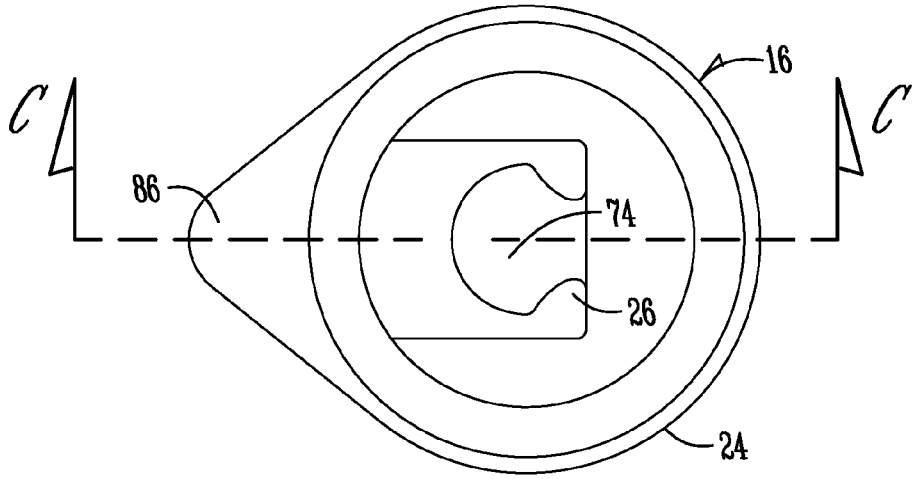
FIG. 8 is a perspective top view of the main body of the golf hole painter of FIG. 1.
Figure 9:
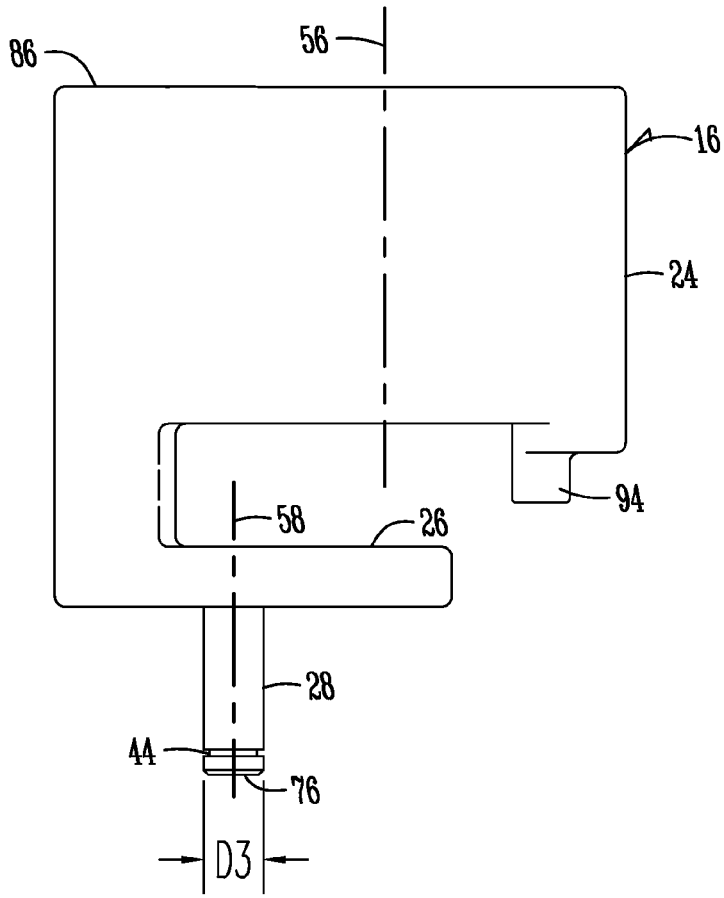
FIG. 9 is a perspective front view of the main body of FIG. 8.
Figure 10:
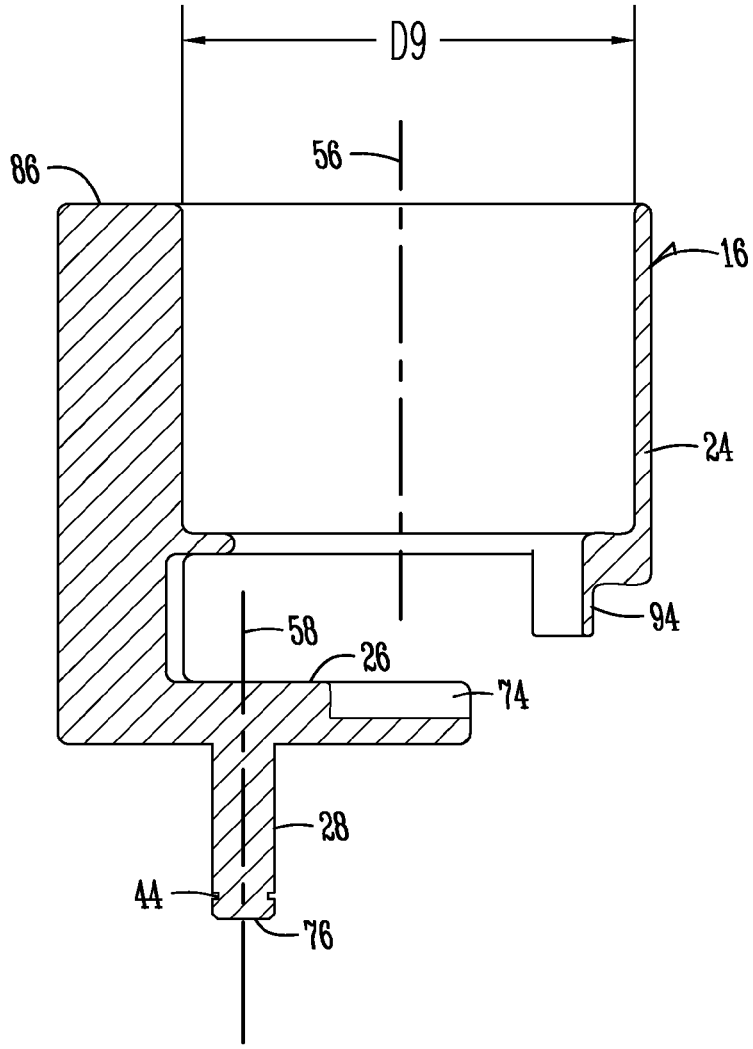
FIG. 10 is a sectional view of the main body according to line C-C of FIG. 8.

Referring now to FIGS. 8-10, the main body 16 will be described in greater detail. The main body 16 may include a canister receiving member 24, a nozzle receiving member 26, a main body support 86, which connects the canister receiving member 24 and the nozzle receiving member 26, and also a clevis pin 28, which extends downwardly from the bottom of the nozzle receiving member 26. Additionally, the main body 16 may also include a paint blocking member 94, which extends slightly downward from the canister receiving member 24. As is shown in FIGS. 8 and 10, the canister receiving member 24 is generally circular shaped and includes a canister receiver axis 56. The clevis pin 28 includes an axis 58. As can be seen in FIGS. 9 and 10, the canister receiver axis 56 is offset from the clevis pin axis 58. The canister receiving member 24 also includes a canister receiver diameter D9, which is sized to receive a spray canister 50. The nozzle receiving member 26 includes a nozzle receiver 74, which is shaped to receive a standard spray canister nozzle 52. It may also be acceptable to use a spray canister that includes a spray canister nozzle 52 that rotates independent of the canister. Additionally, the clevis pin 28 has a clevis pin diameter D3, and may include a clevis pin annular groove 44 around the clevis pin 28. The clevis pin diameter D3 is smaller than the liner inner diameter D1 such that the clevis pin 28 can be inserted into the liner 14. As mentioned above, it may be desired to include a paint blocking member 94 extending partially downward from the canister receiving member 24 of the main body 16, which ensures that paint will not be sprayed where it is not wanted, i.e. on the putting surface 80.

The main body 16 may be formed of die cast aluminum, but other suitable materials may be used as desired. Additionally, in another embodiment, the clevis pin 28 may be formed separate from the rest of the main body. In this additional embodiment, the nozzle receiving member 26 may contain an aperture, into which the separate clevis pin would be attached.

Figure 3A:
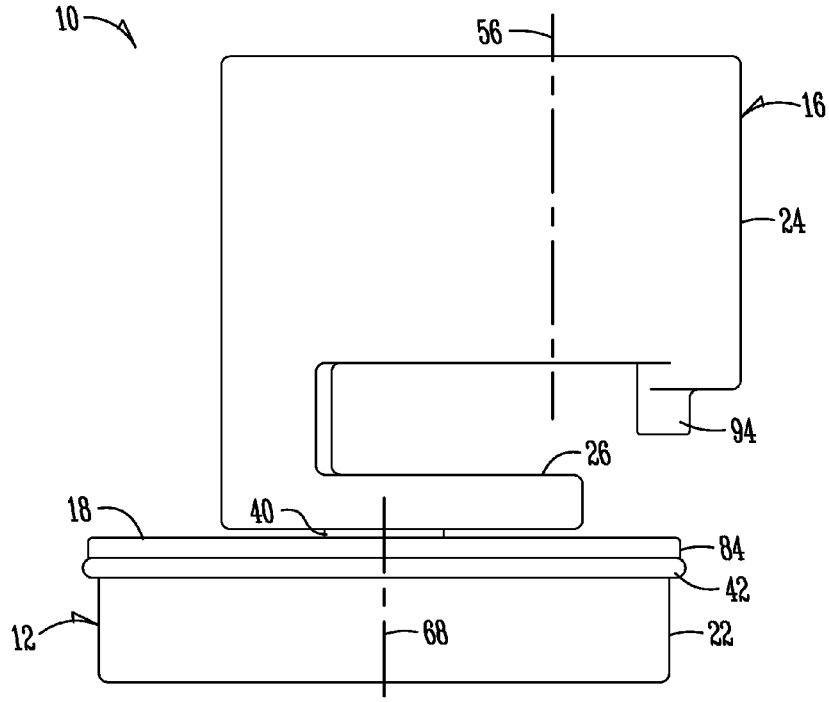
FIG. 3A is a perspective front view of the golf hole painter of FIG. 2.
Figure 3B:
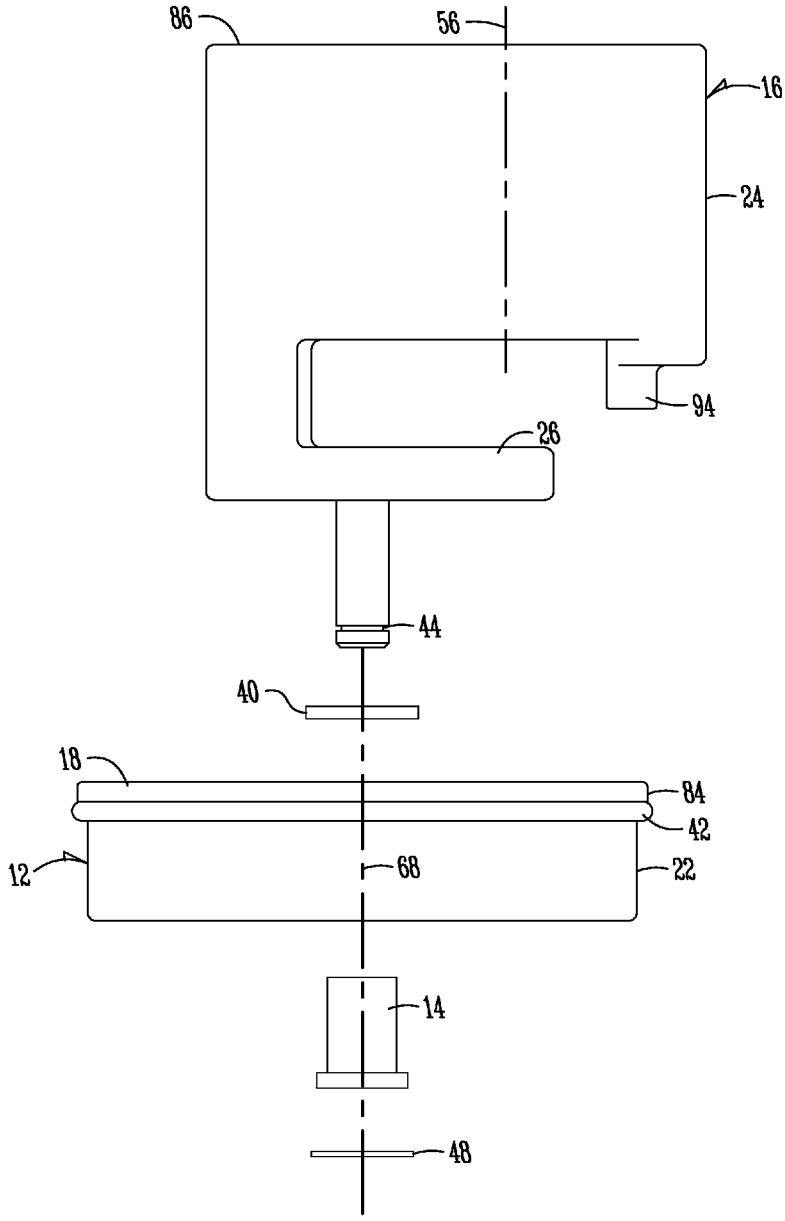
FIG. 3B is an exploded view of the golf hole painter of FIG. 3A.
Figure 4:
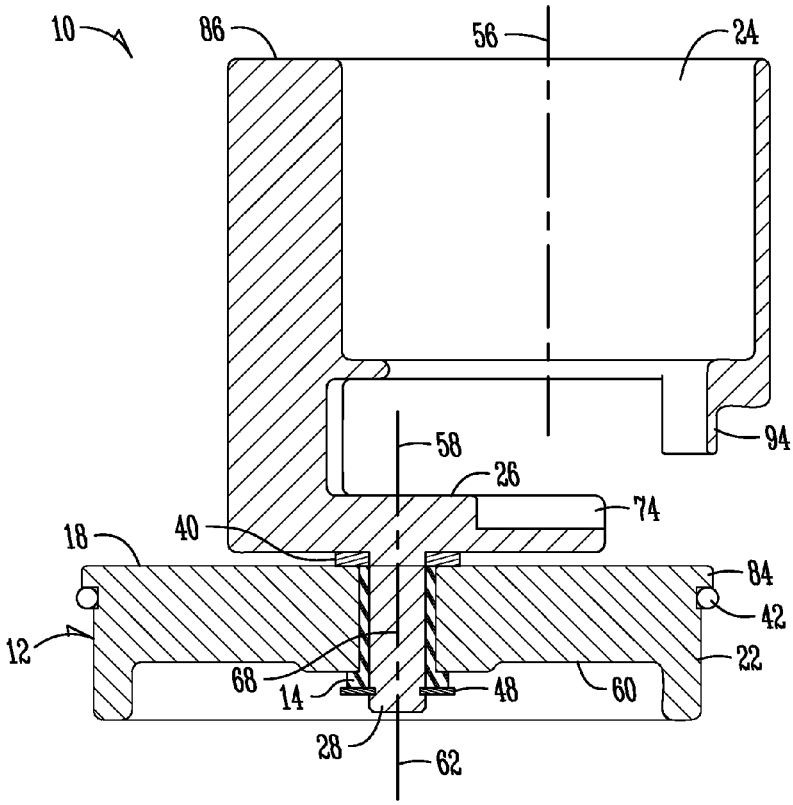
FIG. 4 is a sectional front view according to line A-A of FIG. 2.

Referring back to FIGS. 2-4, the golf hole painter 10 is provided. To assemble the golf hole painter 10, the liner 14 is first press fit into the base aperture 20, wherein the first end 64 of the liner 14 is approximately flush with the top member 18. The clevis pin 28 of the main body 16 is then inserted into the liner 14. Additionally, a washer 40 may first be included around the clevis pin between the main body 16 and the base 12, and a snap ring 48 may be attached to the clevis pin 28 at the clevis pin annular groove 44 after the clevis pin 28 has been inserted into the liner 14. This may be done to ensure that the golf hole painter 10 does not come apart. Further, a O-ring 42, preferably made of rubber, may be attached to the base member 12 at the base wall annular groove 46 and just below the top member 18, to rest on a golf cup rim 38 to better seal the interior of a golf cup 36 from paint from a spray canister 50. As shown in FIGS. 3 and 4, the canister receiver axis 56 is offset from the base member axis 68, the liner axis 62, and the clevis pin axis 58, which are all aligned when assembled. Because the canister receiving member 24 is offset from the center of the golf hole painter 10, the spray canister nozzle 52 in the nozzle receiver 74 will be closer to the golf hole interior periphery 34, such that the resulting spray will be more consistent and desired.

Figure 11A:
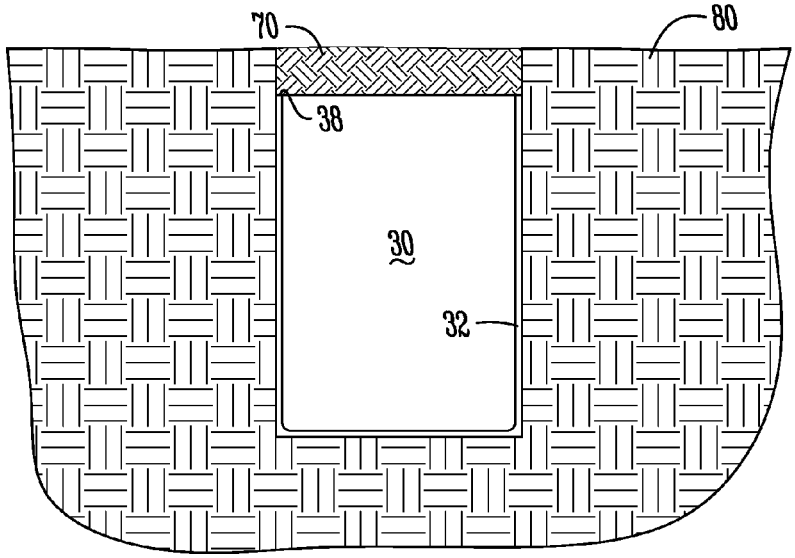
FIG. 11A is a sectional view of a golf hole having a golf cup residing within.

FIGS. 11A-D are step by step drawings of the method of use of the golf hole painter 10. FIG. 11A is a sectional view of a golf hole 30 having a golf cup 32 residing within. The golf cup rim 38 of the golf cup 32 must sit at least one inch below the putting surface 80, as stated in the rules of golf. The golf cup 32, including the interior of the golf cup 36, is generally a white or lighter color so as to distinguish the cup from the soil and earth from which it is cut out of. However, there remains an unpainted portion 70 of the golf hole 30, which remains earth colored, i.e. brown. This section may cause a golf hole 30 to be hard to see from a distance away from the hole.

Figure 11B:
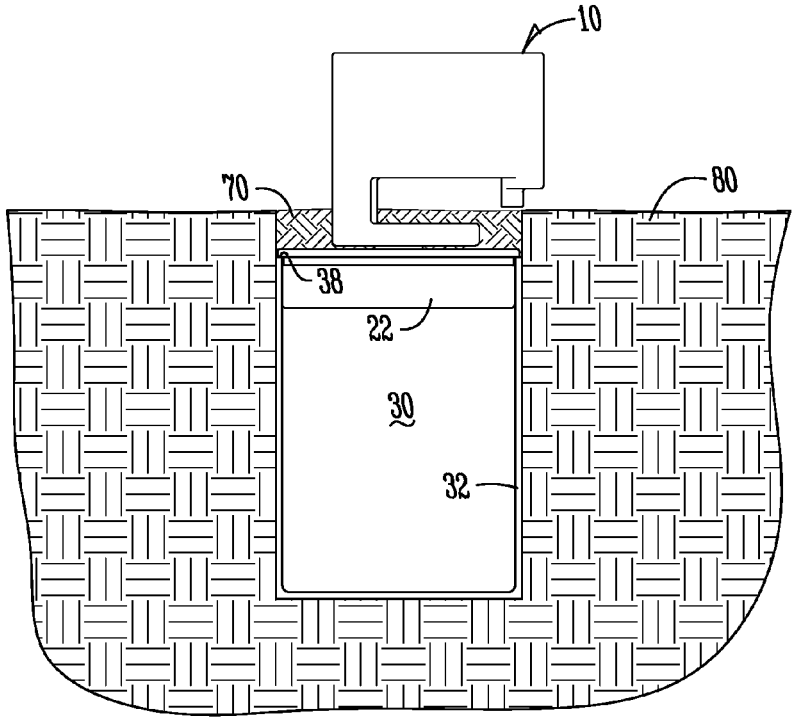
FIG. 11B is a sectional view of a golf hole and cup with the golf hole painter in place.

FIG. 11B is a sectional view of the golf hole 30 and cup 32 of FIG. 11A, but with the golf hole painter 10 in place. The top member lip 84 of the base member 12 is sized to rest upon the golf cup rim 38. The wall diameter D6 is less than the diameter of the golf cup 32, such that the wall 22 will reside within the golf cup 32 when the golf hole painter 10 is in place. A rubber O-ring 42 may be placed in the base wall annular groove 46, wherein the O-ring 42 will rest on the golf cup rim 38. The O-ring 42 may provide a better seal to ensure that paint will not drip into the golf cup 32.

Figure 11C:
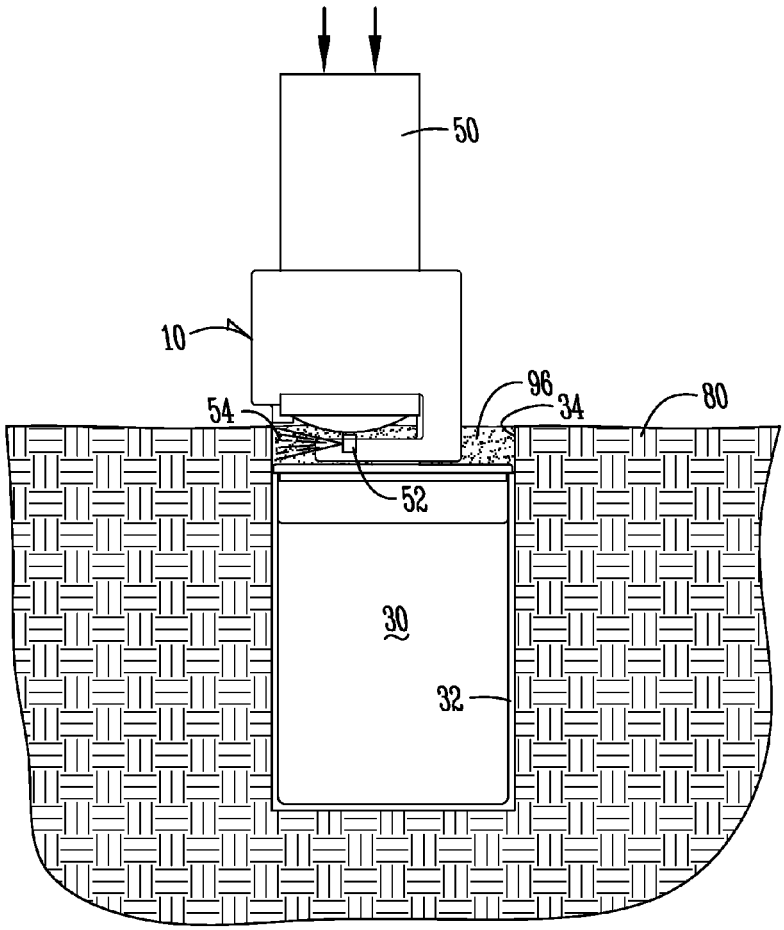
FIG. 11C is a sectional view of FIG. 11B with a spraying canister placed in the golf hole painter.
Figure 11D:
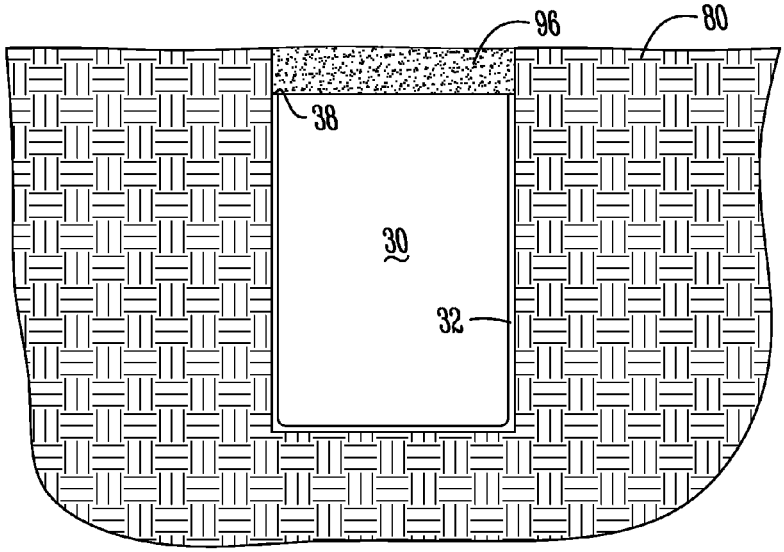
FIG. 11D is a sectional view of FIG. 11A after the spraying canister has been rotated partially about the interior periphery of the golf hole, and the golf hole painter has been used to paint the uncovered interior of the golf hole.

FIG. 11C is a sectional view of FIG. 11B after a spraying canister 50 has been placed in the golf hole painter 10. The spraying canister 50 is inserted through the canister receiving member 24 to a position where the spray canister nozzle 52 is placed into the nozzle receiver 74 such that the opened end of the spray canister nozzle (not shown) is facing a generally outwardly direction. The user may then press down on the spray canister 50 to initiate a paint stream 54 to emit from the spray canister nozzle 52. The paint stream 54 spreads and reaches the golf hole interior periphery 34, painting the interior a desired color. While continuing to press down on the spray canister 50, the main body 16 of the golf hole painter 10 may be rotated around the golf hole interior periphery 34, to paint the entire uncovered interior of the golf hole 30. The top member lip 84 and the paint blocking member 94 ensure that the paint stream 54 does not spread more than what is desired, which is the approximately one inch strip of the interior of the golf hole 30 as required by the USGA, and which has been previously earth in color. When the spray canister 50 has painted the entire 360° of the interior of the golf hole 30, first the spray canister 50 is removed from the golf hole painter 10, and then the golf hole painter 10 is removed from the golf hole 30. The result is shown in FIG. 11D, which is the interior of the golf hole 30 being painted a color similar to the color of the golf cup 32, such that a golfer may more easily see the golf hole 30 from a distance away from the golf hole 30. The painted strip 96 will stand out from the putting surface 80.

While the method has been described above, it may also be accomplished by inserting the spraying canister 50 into the golf hole painter 10 prior to inserting the golf hole painter 10 into the golf hole 30. Additionally, the golf hole painter 10 may be removed from the golf hole 30 with the spray canister 50 still inserted in the canister receiving member 24 of the golf hole painter. The other steps (pressing, rotating, etc.) will remain the same.

The invention has been shown and described above with reference to the preferred embodiments, and it is understood that many modifications, substitutions, and additions may be made which are within the intended spirit and scope of the invention. The invention is only to be limited by claims pended hereto.

What is claimed is:

1. A golf hole painter comprising:

a base member of a generally circular shape, the base member having a top member, an aperture through the top member, and a wall extending downwardly from the top member;

a liner positioned in the aperture of the base member;

a main body comprising a canister receiving member operably connected to a nozzle receiving member, and a clevis pin extending outwardly from the nozzle receiving member; and the main body rotatably connected to the liner such that the canister receiving member is configured to rotate about the entire interior periphery of a golf hole.

2. The golf hole painter of claim 1 further comprising a washer positioned about the clevis pin at a location between the main body and the base member.

3. The golf hole painter of claim 1 further comprising an o-ring positioned around the wall of the base member adjacent the top member, wherein the o-ring is configured to rest on a rim of a golf cup.

4. The golf hole painter of claim 1 wherein the clevis pin having an annular groove at a position away from the nozzle receiving member.

5. The golf hole painter of claim 4 further comprising an annular snap ring operably connected at the annular groove of the clevis pin.

6. The golf hole painter of claim 1 wherein the base member further comprises a plurality of support members evenly spaced about the base member, the support members extending from the wall of the base member to the aperture of the base member.

7. The golf hole painter of claim 1 wherein the canister receiving member having a circular shape for receiving circular canisters.

8. The golf hole painter of claim 7 wherein the canister receiving member having a canister receiver axis through the center of the canister receiving member, the clevis pin having a clevis pin axis through the center of the clevis pin, and the canister receiver axis is offset from the clevis pin axis.

9. The golf hole painter of claim 8 wherein the liner having a liner axis through the center of the liner, and the clevis pin axis is aligned with the liner axis.

10. The golf hole painter of claim 1 wherein the base member further comprises an annular base groove at a position in the wall proximate the top member.

11. The golf hole painter of claim 10 wherein an o-ring is operably connected to the base member at the base groove.

12. The golf hole painter of claim 1 wherein the aperture through the base member is circular, and has an aperture diameter.

13. The golf hole painter of claim 12 wherein the liner further comprises opposite first and second ends, an outer diameter, and an inner diameter.

14. The golf hole painter of claim 13 wherein the aperture diameter is slightly larger than the outer diameter of the liner.

15. The golf hole painter of claim 1 wherein the nozzle receiving member having a nozzle receiver configured to receive a nozzle of a spraying canister.

16. The golf hole painter of claim 1 wherein the golf hole painter is configured for placement in a golf hole such that the top member rests on a golf cup rim and the base wall is configured to fit in the interior of the golf cup.

17. A method of painting an interior of a golf hole comprising:

providing a golf hole painter including a base member having a top member, an aperture through the top member and a base member wall, a liner positioned in the aperture of the base member, and a main body having a canister receiving member, a nozzle receiving member, a clevis pin extending outwardly from the nozzle receiving member and rotatably connected to the liner, and a spraying canister containing paint and having a spraying nozzle;

inserting the golf hole painter into a golf hole having a golf cup residing therein, wherein the top member being adapted to rest on a rim of the golf cup;

inserting the spraying canister through the canister receiving member;

inserting the spraying nozzle into the nozzle receiving member; and pressing downwardly on the spraying canister to initiate spraying paint from the spraying canister.

18. The method of claim 17 further comprising rotating the golf hole painter with the spraying canister while pressing down on the spraying canister to paint the interior periphery of the golf hole above the golf cup.

19. The method of claim 17 wherein the golf hole painter is rotated at least 360°.

20. The method of claim 17 further comprising providing an o-ring operably connected around the base member wall below the top member.

21. The method of claim 20 wherein the o-ring rests on the rim of the golf cup when the golf hole painter is inserted into a golf hole having a golf cup residing therein.

22. The method of claim 17 wherein the spraying nozzle of the spraying canister rotates independent of the spraying canister.

23. The method of claim 17 wherein inserting the spraying canister into the canister receiving member is done prior to inserting the golf hole painter into the golf hole.

24. The method of claim 17 wherein the golf hole painter is removed from the golf hole with the spraying canister still inserted into the golf hole painter.

25. A golf hole painting apparatus comprising:

a base member being of a generally circular shape and having a top member, a base member wall extending downwardly from the top member, a circular aperture through the top member and having a base member axis though the center of the base member, and an annular groove in the base member wall below the top member;

a liner of a generally circular shape forcibly fit into the circular aperture, the liner having first and second ends, an inner diameter, and an outer diameter, wherein the outer diameter is slightly smaller than the diameter of the circular aperture of the base member;

a main body rotatably connected to the liner such that the canister receiving member is configured to rotate about the entire interior periphery of a golf hole; and the main body comprising:

a. a circular canister receiving member having an canister receiver axis through the center of the canister receiving member;

b a nozzle receiving member attached to the canister receiving member and having a nozzle receiver, wherein the nozzle receiver is aligned with the canister receiver axis; and c. a clevis pin extending outwardly from the nozzle receiving member having a clevis axis through the center of the clevis pin, a clevis pin end away from the nozzle receiving member, and a clevis groove at a position proximate the clevis pin end, wherein the clevis axis is offset from the canister receiver axis.

26. The apparatus of claim 25 further comprising a washer, wherein the clevis pin is inserted through the washer and then through liner to a position wherein the washer abuts both the nozzle receiving member of the main body and the top member of the base member.

27. The apparatus of claim 25 further comprising a snap ring fit into the clevis groove at a position below the top member of the base member.

28. The apparatus of claim 25 wherein the apparatus is configured for placement in a golf hole such that the top member rests on a golf cup rim and the base wall is configured to reside within the interior of the golf cup.

29. The apparatus of claim 25 wherein a diameter of the clevis pin is less than the inner diameter of the liner.

30. The apparatus of claim 25 wherein the base member further comprises a plurality of stability members spaced evenly between the interior of the base wall and the circular aperture.

31. The apparatus of claim 25 further comprising an o-ring positioned in the annular groove of the wall of the base member, wherein the o-ring is adapted to rest on a rim of a golf cup.

32. The apparatus of claim 31 wherein the apparatus is configured for placement in a golf hole such that the o-ring rests on a golf cup rim and the base wall is configured to reside within the interior of the golf cup.

* * * * *